US005303487A

United States Patent [19]

Olson

[11] Patent Number: 5,303,487

[45] Date of Patent: Apr. 19, 1994

[54] WINDOW DISPLAY CARD

[76] Inventor: Heidi S. Olson, 519 Beachview La., Barrington, Ill. 60010

[21] Appl. No.: 973,425

[22] Filed: Nov. 9, 1992

[51] Int. Cl.[5] ..... G09F 1/00

[52] U.S. Cl. ..... 40/124.1; 40/152

[58] Field of Search ..... 40/124.1, 158.1, 152, 40/594, 595; 283/117; 281/29; 446/147, 901; 229/92.8

[56] References Cited

U.S. PATENT DOCUMENTS

| | | | |
|---|---|---|---|
| 922,035 | 5/1909 | Pifer | 229/92.8 X |
| 3,885,336 | 5/1975 | Olsen | 40/152 |
| 4,008,852 | 2/1977 | Davis | 229/92.8 X |
| 4,662,093 | 5/1987 | Suttles et al. | 229/92.8 |
| 4,825,574 | 5/1989 | George | 229/92.8 X |

FOREIGN PATENT DOCUMENTS

| | | | |
|---|---|---|---|
| 1393199 | 5/1975 | United Kingdom | 40/158.1 |

*Primary Examiner*—Brian K. Green
*Attorney, Agent, or Firm*—McHale & Slavin

[57] ABSTRACT

A window display card for consumer personalization by placement of a display item within a window provision. The card is constructed of a single sheet of paper having a rectangular shape and divided into three equally dimensioned sections. A framing section includes a centrally disposed window for viewing a display item. Two sided pressure sensitive adhesive strips are provided across an upper and lower portion of the inner surface of the framing section for securing the display item and sealing to a backing section. The display item aligned by use of geometrically provided alignment lines projecting from the aperture. The backing section is hingedly attached to the framing section sealing the item of display between the sections allowing visual display through the window. The remaining section is available for personalized writings in a similar manner to a conventional card.

10 Claims, 2 Drawing Sheets

WINDOW DISPLAY CARD

FIELD OF THE INVENTION

This invention relates generally to greeting cards and, more particularly, to a consumer modifiable window display card.

BACKGROUND OF THE INVENTION

Illustrated cards bearing a message or greeting are well known in the art. Such cards are tailored for a particular occasion, i.e., birthday, wedding, graduation, and can be further classified into various subcategories i.e., son, daughter, cousin, parent, grandparent, and so forth. The result is literally thousands upon thousands of cards that can be viewed for purchase by a consumer. Despite the voluminous amount of cards, there exists a market of consumers who are particular of the message they wish to convey. This particularity may result from failure to find a commercially prepared card that reflects the moment; or the cost to purchase a commercially prepared card, or simply a desire to send a truly personalized card.

Card manufactures provide little in the way of personalized cards. Typically the consumer purchases a commercially prepared card and is limited in the manner of personalizing by signature. One known attempt to assist consumers to personalize cards are window display cards formed from a pocket sealed during the manufacture of the card. The consumer can slide a photograph into the pocket for viewing through a cut out disposed in one of the sides of the card.

One problem with pocket window cards is the limitation of display items, typically a photograph is the extent of acceptable items. In addition, maintaining the photograph within the pocket requires adhesive that is placed on the back of the photograph or within the pocket. The adhesive makes photograph placement difficult. In addition, the narrow pocket opening limits the size of photograph, is difficult to align, and typically cannot be reused.

Thus, heretofore the consumer is limited in their card choice to commercially prepared cards conveying generic messages. Fanciful commercial cards are beyond the reach of many consumers who cannot afford such a luxury. While the pocket windows have attempted to resolve these problems, no satisfactory solution has heretofore been provided. The instant invention is specifically designed to overcome the aforementioned problems and disadvantages. It is, therefore, to the effective resolution of these problems that the present invention is directed.

SUMMARY OF THE INVENTION

The principle object of the present invention is to provide a simple and inexpensive window display card which overcomes the difficulties previously mentioned by means of an aesthetically pleasing card that is customized by the consumer.

The instant invention is a window display card constructed of a single sheet of paper having a substantially rectangular shape divided into three equally dimensioned sections by two fold lines. A middle section defines a framing section bounded by the first and second fold line and the top and bottom edge of the sheet. The framing section includes a centrally disposed window, hereinafter referred to as an aperture, with a plurality of geometrically drawn lines located on one side surface extending equal-distantly outwardly from the aperture. The aperture can be round, oval, square, rectangular, or made into a design opening.

A pressure sensitive adhesive strip is placed across the upper and lower portion of the framing section. One side of the tape includes a removable cover for application. Upon application, the covers are removed and an item of display can be located over the aperture utilizing the geometrically drawn lines for centrally locating the item. The item of display adheres to a portion of the tack tape, the remaining tack tape available for attachment of a backing section of the sheet.

The backing section is defined by the first fold line, top edge, bottom edge, and one side edge of the sheet. The backing section is folded at the first fold line sealing the item of display between the two sections allowing visual display only through the aperture. The backing section sealing to the framing section by the common use of the adhesive tape.

The remaining section is available for placement of writings. Defined by the second fold line, top edge, bottom edge and one side edge of the sheet, the section is folded at the second fold line forming a conventional card in conjunction with the backing section. The surface of the backing section and remaining section available for placement of indicia thereon.

Thus an objective of the instant invention is to provide a consumer customized window display card incorporating a means for securing an item of display therein for viewing through a cutout.

Still another objective of the instant invention is to provide a means for aligning an item of display to assist the consumer with the exact centering of the item.

Yet still another objective of the instant invention is to utilize a common adhesive that attaches to the front of a display item and is further utilized to seal the backing sheet to the display item.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

As required, detailed embodiments of the present invention are disclosed herein, however, it is to be understood that the disclosed embodiments are merely exemplary of the invention which may be embodied in various forms. Therefore, specific functional and structural details disclosed herein are not to be interpreted as limiting, but merely as a basis for the claims and as a representative basis for teaching one skilled in the art to variously employ the present invention in virtually any appropriately detailed structure.

Figure 1:
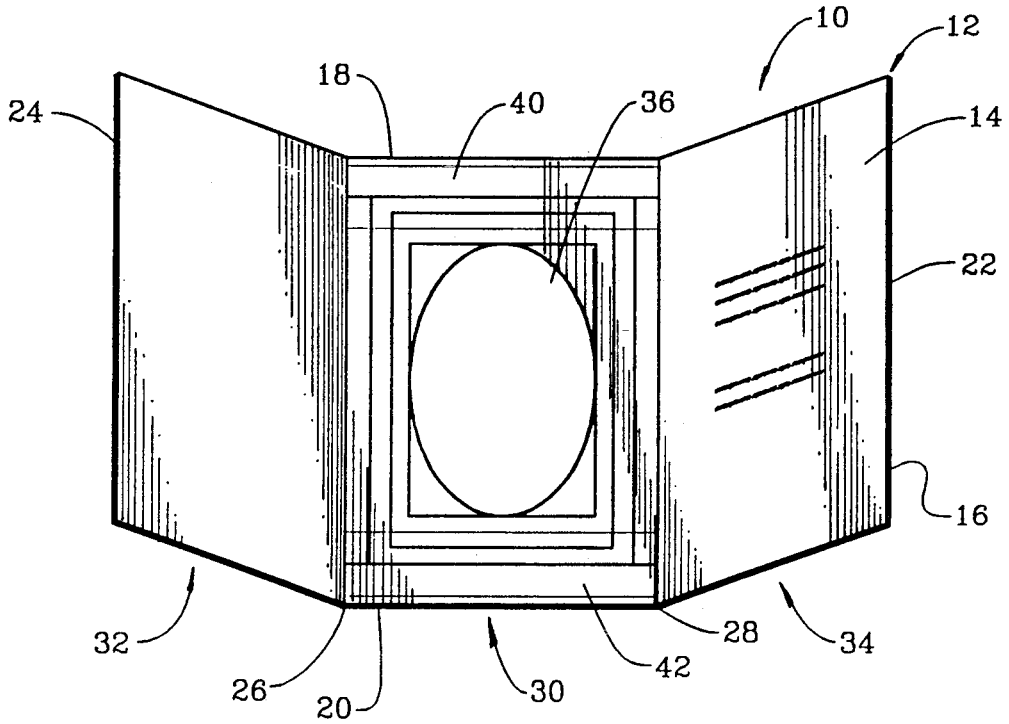
FIG. 1 is a perspective view showing the instant invention with an oval aperture.
Figure 2:
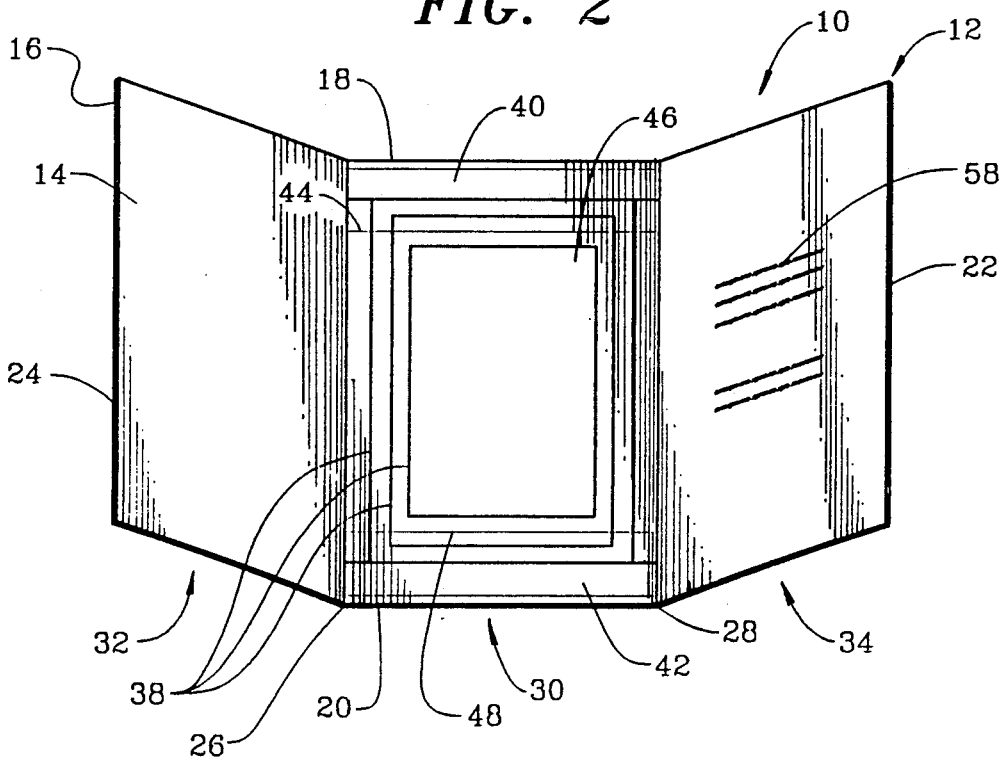
FIG. 2 is a perspective view showing the instant invention with a rectangular aperture.

Now referring in general to FIGS. 1 and 2, shown is a perspective view of the instant invention 10 comprising a single sheet of material 12 constructed of paper having a front side surface 14 and a rear side surface 16. The sheet 12 is substantially rectangular in shape and defined by a top edge 18, bottom edge 20, left side edge 22 and right side edge 24. The sheet 12 is further divided into three equally dimensioned sections by use of a first fold line 26 and a second fold line 28. The fold lines demarcate a framing section 30, a backing section 32, and an indicia section 34.

The framing section 30 includes a peripheral bordered by the first and second fold lines 26, 28 and top and bottom edges 18, 20, respectively. As seen in FIG. 1, a centrally disposed cutout or aperture 36 in the shape of an oval communicates the front surface 14 and rear surface 16. Alternatively, as shown in FIG. 2, a rectangular aperture is provided for the window. It should be noted that the shape of the aperture is not deemed a limitation of this invention. Operatively associated with the apertures are a plurality of geometrically drawn lines 38 located on surface 14 of the framing section 30 extending equal-distantly outwardly from the apertures 36, 46.

A first transparent substantially continuous pressure sensitive adhesive strip 40 is positioned across an upper portion of the inner surface 14 of framing section 30. The first adhesive strip 40 extending to a position adjacent to the aperture ,as depicted by line 44 in FIG. 2. A second transparent substantially continuous pressure sensitive adhesive strip, 42, shown in FIG. 1 with a cover placed over the adhesive, is formed across a lower portion of the inner surface 14 of the framing section 30 extending to a position adjacent to the apertures as depicted by line 48. One portion of each adhesive strip is utilized to secure an item of display thereto. The remaining portion of each adhesive strip is available for adhesion to the backing section thus sealing the item of display between the framing section and the backing section. Preferably, the adhesive is a separately formed adhesive strip having adhesive on two sides, one side being of a high tack used to adhere the strip to the sheet 12 and the other of relatively low tack to secure the item of display and backing section.

The backing section 32 is identified by the first fold line 26, top edge 18, bottom edge 20 and side edge 24. The backing section 32 is made available to fold over the framing section 30 along fold line 26. When the adhesive strips 40 and 42 are exposed, the backing section will adhere to the tape creating a secure backing to framing section 30. Upon backing section 32 adherence to framing section 30, the card forms a conventional two page card receptive to writings 58 on the now inner surface of the backing section as well as the indicia section 34. The indicia section 34 is defined by the second fold line 28, top edge 18, bottom edge 20, and side edge 22. The backing section 32 is secured to the framing section 30 sealing an item of display between the inner surfaces. It should be noted that the backing section and indicia section can be reversed.

Figure 3:
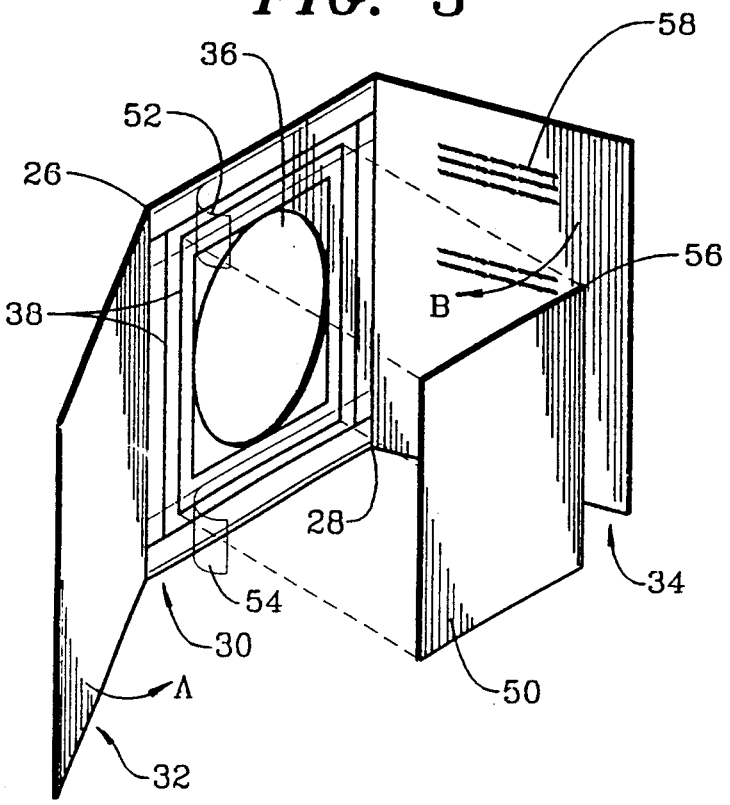
FIG. 3 is an exploded perspective view illustrating an item of display for positioning over an aperture.

Now referring to FIG. 3, an item of display 50 is shown in alignment over the oval aperture 36 for attachment thereto. Attachment performed by removal of the covering sheets 52 and 54 placed over the adhesive portions 40 and 42. The item of display 50 aligned to the geometrically drawn lines 38 by use edge 56 to assist in centering over the aperture 36.

The item of display can be any item of preference the consumer wishes to display. For example, a partial list of items that could be displayed include: announcements, cartoons, comic strips, collages, coupons currency, doilies, drawings, dried flowers, fabric swatches, handkerchiefs, horoscopes, images from magazines, locket of hair, needlepoint, lottery tickets, old can labels, origami, photographs, poems, postcards, quilt squares, quotes, recipe cards ribbons, seed packets, sheet music, stamps, stickers, tickets to an event, used greeting cards, watercolors, and wine bottle labels to name a few.

After the item of display 50 is centered over the aperture 36 and adhered to the adhesive strips, the backing section 32 is folded at fold line 26 in the direction designated by the letter A to encompass the side surface of the framing section 30. The backing section 32 sealing the item of display 50 between the sections for visual display through the aperture. The backing section 32 adhering to the exposed adhesive tape not utilized by the item of display. The use of low tack adhesive for backing attachment allows the card or item of display to be reused. Alternatively, a high tack adhesive can be used for the backing attachment for permanently sealing an item of display within the card. Backing section 32 and indicia section 34 are foldable at the second fold line 28 in the direction of letter B.

Figure 4:
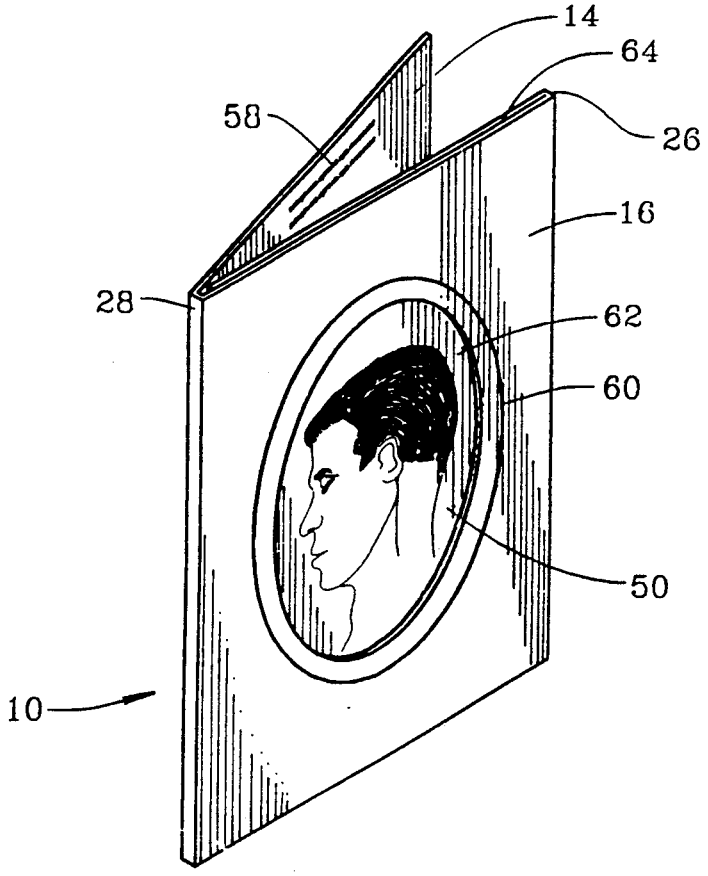
FIG. 4 is a perspective view of the front of the display card illustrating an item of display for viewing through the aperture.

Now referring to FIG. 4, the window display card 10 of the instant invention is shown wherein the item of display 50 is clearly depicted through the aperture of surface 16. The aperture can be further framed by a design or rim configuration 60 to highlight the aperture. Optionally, a plastic film overlay 62 can be placed within the pocket 64 before sealing to provide a commercially prepared appearance to the card. The plastic overlay allows the display of items that would otherwise fall through the opening or could be damaged by touching. For example, a leaf could be displayed wherein the use of a plastic overlay will provide a window type appearance.

It is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What I claim as new and desire to secure by Letters Patent of the United States is:

1. An improved window display card using commercially available two sided tape for use in securing personal items for display through a predefined windowframe providing a personalized greeting card, said display card comprising: a substantially rectangular single sheet of paper having two side surfaces, said sheet divided into three equally dimensioned sections by a first fold line and a second fold line defining a framing section, a backing section, and an indicia section; said framing section further defined by said first and second fold lines and two edges with a centrally disposed aperture therethrough; said backing section further defined by said first sold line and three edges; said indicia section further defined by said second fold line and three edges; wherein the improvement comprises a first transparent two sided pressure sensitive adhesive strip positioned cross an upper portion of one side surface of said framing section and a second transparent two sided pressure sensitive adhesive strip positioned across a lower portion of said one side surface of said framing section, said adhesive strips protected by removable cover sheets; and a means for aligning an item of display directly over said aperture of said framing section, a portion of said aligning means being covered by said adhesive strips; whereby removal of said cover sheets from said adhesive strips permits visual sighting of said means or aligning through said adhesive strips allowing an item of display to be properly positioned over said aperture and secured thereto, said backing section is then available to be folded at said first fold line sealing said items of display between said framing and backing sections for visual display through said aperture, said backing section and said indicia section foldable at said second fold line for use as a conventional greeting card.

2. The window display card according to claim 1 wherein said first and second adhesive strips having high tack for application against said one side surface of said framing section and low tack for releasble application to said item of display and said backing section.

3. The window display card according to claim 1 wherein said first and second adhesive strips having high tack for application against said one side surface of said framing section and high tack for permanent application to said item of display and said backing section.

4. The window display card according to claim 1, wherein an opposite side surface of said one side surface of said framing section includes a means for framing said aperture.

5. The window display card according to claim 1 wherein said backing section and said indicia section are reversed.

6. The window display card according to claim 1 wherein said aperture is substantially circular.

7. The window display card according to claim 1 wherein said aperture is substantially rectangular.

8. The window display card according to claim wherein said means for aligning is defined as a plurality of geometrically drawn lines located on said one side surface of said framing section, said lines extending equal-distantly outwardly from said aperture.

9. The window display card according to claim 1 wherein said aperture includes a plastic film overlay.

10. An improved window display card using commercially available two sided tape for use in securing personal items for display through a predefined window frame providing a personalized greeting card, said display card comprising: a substantially rectangular single sheet of paper having two side surfaces, said sheet divided into three equally dimensioned sections by a first fold line and a second fold line defining a framing sections, a backing section, and an indicia section; said framing section defined by said first and second fold lines and two edges with a centrally disposed aperture therethrough; said backing section defined by said first fold line and three edges; said indicia section defined by said second fold line and three edges; wherein the improvement comprising a first transparent two sided pressure sensitive adhesive strip positioned across an upper portion of a first side surface of said framing section and a second transparent two sided pressure sensitive adhesive strip positioned across a lower portion of said firs side surface of said framing section, said adhesive strips being selected to have a relative high tack on one side for attaching said framing section and a relatively low tack for attaching an item of display thereto, said low tack protected by a removable cover sheet; and a plurality of geometrically drawn alignment lines located on said first side surface of said framing section, said liens extending equal-distantly outwardly from said aperture, a portion of said lines being covered by said adhesive strips and being visible through said adhesive strips; whereby removal of said cover sheet from said adhesive strips permits visual sighting of said alignment lines through said adhesive strips allowing an item of display to be properly positioned over said aperture and secured thereto, said backing section is then available to be folded at said first fold line sealing said item of display between said framing and backing sections for visual display through said aperture, said backing section and said indicia section foldable at said second fold line for use as a conventional greeting card.

* * * * *